US007346292B2

(12) United States Patent
Williams et al.

(10) Patent No.: US 7,346,292 B2
(45) Date of Patent: Mar. 18, 2008

(54) SYSTEMS AND METHODS FOR REMANUFACTURING IMAGING COMPONENTS

(75) Inventors: James R. Williams, Sims, NC (US); Donald R. Huck, Raleigh, NC (US); James H. Jones, Fayetteville, NC (US); Anthony D. Causey, Fuquay-Varina, NC (US); Thomas J. Martin, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 362 days.

(21) Appl. No.: 11/193,944

(22) Filed: Jul. 28, 2005

(65) Prior Publication Data

US 2007/0025759 A1 Feb. 1, 2007

(51) Int. Cl.
*G03G 15/00* (2006.01)

(52) U.S. Cl. ..... 399/109

(58) Field of Classification Search ..... 399/109, 399/159, 164, 167

See application file for complete search history.

(56) References Cited

U.S. PATENT DOCUMENTS

| | | | | | |
|---|---|---|---|---|---|
| 5,357,321 | A * | 10/1994 | Stenzel et al. | ..... | 399/167 |
| 5,371,576 | A * | 12/1994 | Gonda | ..... | 399/167 |
| 5,436,699 | A * | 7/1995 | Komaki | ..... | 399/159 |
| 5,461,464 | A * | 10/1995 | Swain | ..... | 399/159 |
| 5,518,847 | A * | 5/1996 | Chen | | |
| 5,579,093 | A * | 11/1996 | Wagner et al. | ..... | 399/159 |
| 5,655,182 | A * | 8/1997 | Sanchez et al. | ..... | 399/167 |
| 5,845,173 | A * | 12/1998 | Zogg et al. | ..... | 399/159 |
| 5,878,310 | A * | 3/1999 | Noda et al. | ..... | 399/167 |
| 6,032,008 | A * | 2/2000 | Kolodziej | ..... | 399/167 |
| 6,088,557 | A * | 7/2000 | Janssen et al. | ..... | 399/159 |
| 6,097,914 | A * | 8/2000 | Tanaka et al. | ..... | 399/159 |
| 6,406,656 | B1 * | 6/2002 | Thompson et al. | ..... | 399/159 |
| 6,481,081 | B1 | 11/2002 | Kilian et al. | | |
| 6,490,426 | B1 * | 12/2002 | Zaman | ..... | 399/167 |
| 6,577,830 | B1 | 6/2003 | Wazana et al. | | |
| 6,684,039 | B1 | 1/2004 | Wazana et al. | | |
| 6,754,460 | B2 | 6/2004 | Lewis et al. | | |
| 6,763,209 | B2 | 7/2004 | Higeta et al. | | |
| 6,788,908 | B2 | 9/2004 | Sekine | | |
| 6,856,775 | B2 | 2/2005 | Sekine | | |
| 6,915,092 | B2 | 7/2005 | Yamaguchi et al. | | |
| 2003/3170045 | | 9/2003 | Lewis | | |
| 2003/0231900 | A1 * | 12/2003 | Toriyama et al. | ..... | 399/159 |
| 2004/0091282 | A1 * | 5/2004 | Yokoi | ..... | 399/109 |
| 2005/0056624 | A1 | 3/2005 | Wazana et al. | | |
| 2005/0115043 | A1 | 6/2005 | Maeshima et al. | | |

FOREIGN PATENT DOCUMENTS

| | | |
|---|---|---|
| EP | 0716354 | 6/1996 |
| EP | 1253487 | 10/2002 |
| EP | 1253487 A1 * | 10/2002 |

* cited by examiner

*Primary Examiner*—Susan Lee

(57) ABSTRACT

Systems and methods of remanufacturing an imaging cartridge including the replacement an organic photo conductor (OPC) drum in the imaging cartridge having end caps which are fixedly secured to the waste bin or other portion of the toner cartridge. In one aspect, the method involves removing the existing OPC drum without detaching the end caps and installing a replacement OPC drum without disturbing the end caps.

6 Claims, 8 Drawing Sheets

SYSTEMS AND METHODS FOR REMANUFACTURING IMAGING COMPONENTS

BACKGROUND

The present invention generally relates to manufacturing, remanufacturing or repairing replaceable imaging components, and more particularly to apparatus and techniques for removing a drum or roller, such as an organic photo conductor (OPC) drum, for example, of a replaceable imaging cartridge adapted for holding marking material.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Laser printer toner cartridges are typically composed of two portions. One of these sections is the waste bin assembly which houses the OPC drum. During the remanufacturing of a laser printer toner cartridge, the OPC drum may need to be replaced due to the wear or damage of the OPC drum. Typically, the OPC drum is held in place by opposing removable plates. These removable plates are typically attached to the waste bin by screws which allow a remanufacturer to easily remove at least one of the removable plates, replace the OPC drum, and reattach the removable plate. Such a technique allows for OPC drum replacement without causing damage to the toner cartridge.

In the case of certain toner cartridges, such as the Hewlett-Packard Color LaserJet 2600, removable plates are not utilized to secure the OPC drum in place. Rather, the OPC drum is held in place by opposing end caps which are not readily removable. These end caps are secured to the waste bin in a substantially permanent fashion using, among other techniques, an adhesive, which prevents any easy disassembly. Moreover, forcing the removal of the end caps causes damage to the end cap and/or the waste bin. This damage results in print defects when the cartridge is reassembled due to the replacement OPC drum not being securely fastened to the waste bin housing as well as changes in the centerline of the OPC drum in relation to other cartridge components which leads to out of round rotation. Therefore, it would be advantageous to provide systems and methods removing an OPC drum in a toner cartridge having end caps which are fixedly secured to the waste bin or other portion of the toner cartridge without removing the fixed end caps.

SUMMARY

In one aspect of the present invention a method of removing an organic photo conductor (OPC) drum from a toner cartridge comprises providing a waste bin assembly comprising an OPC drum held between first and second OPC retaining members secured to the waste bin assembly. The OPC drum includes first and second hubs extending from ends of the OPC drum into the first and second OPC retaining members. The OPC drum is removed from the waste bin assembly without detaching the first and second OPC retaining members from the waste bin assembly.

A more complete understanding of the present invention, as well as further features and advantages of the invention, will be apparent from the following detailed description and the accompanying drawings.

DETAILED DESCRIPTION

Figure 1:
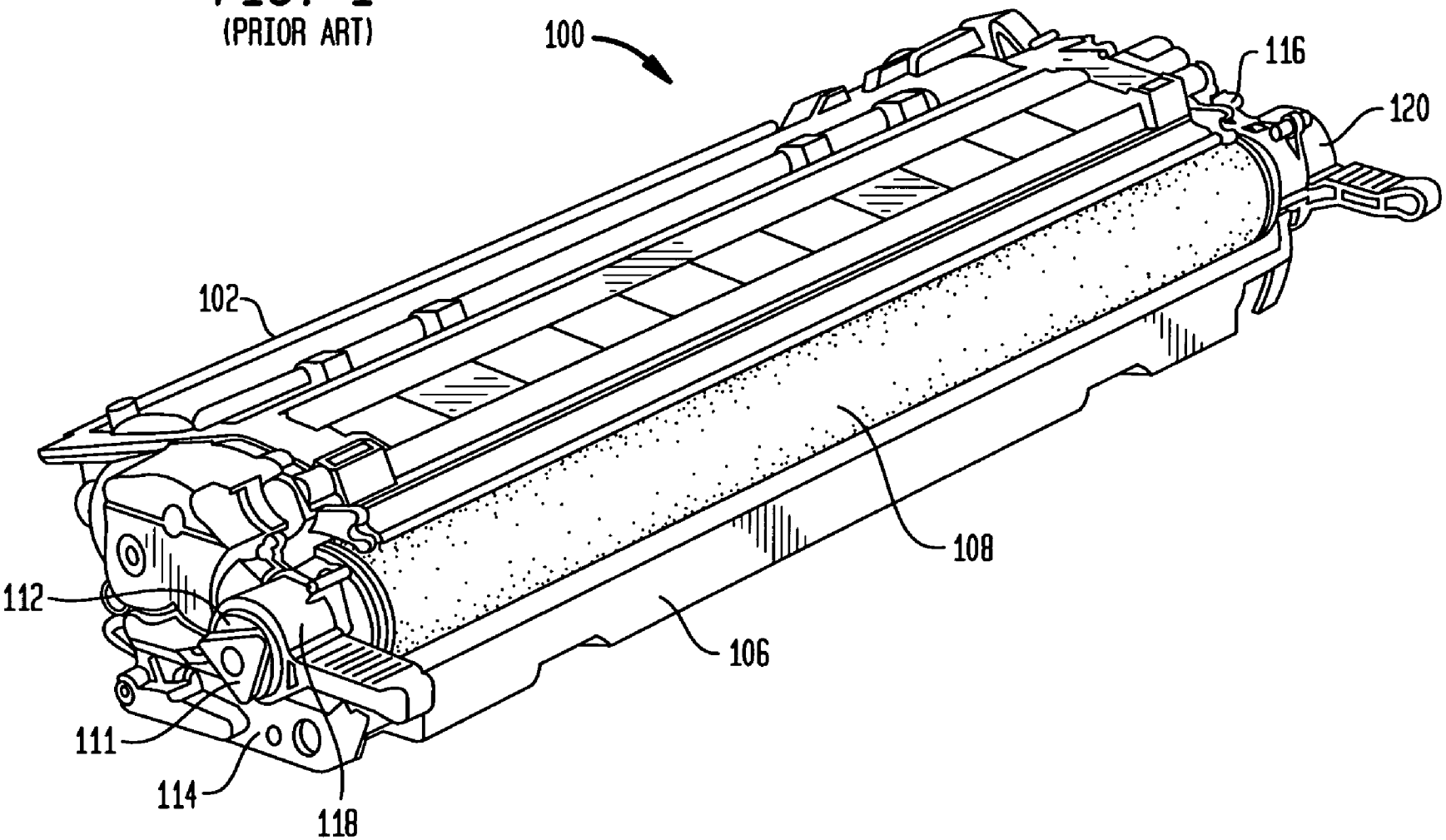
FIG. 1 (PRIOR ART)
FIG. 1 shows a perspective view of the drive side end of an HP 2600 toner cartridge.
Figure 2:
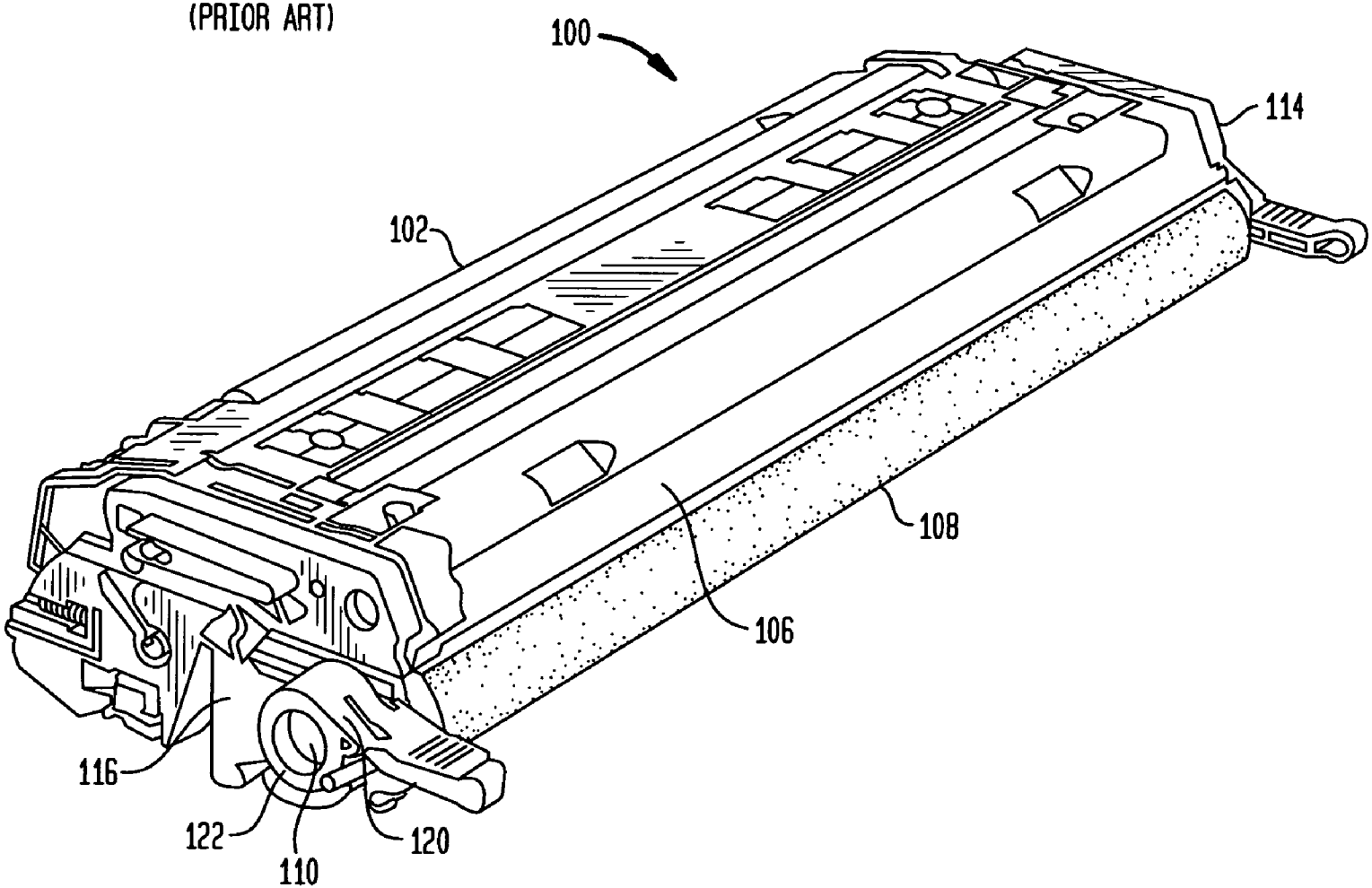
FIG. 2 (PRIOR ART)
FIG. 2 shows a perspective view of the non-drive side end view of an HP 2600 toner cartridge.
Figure 3:
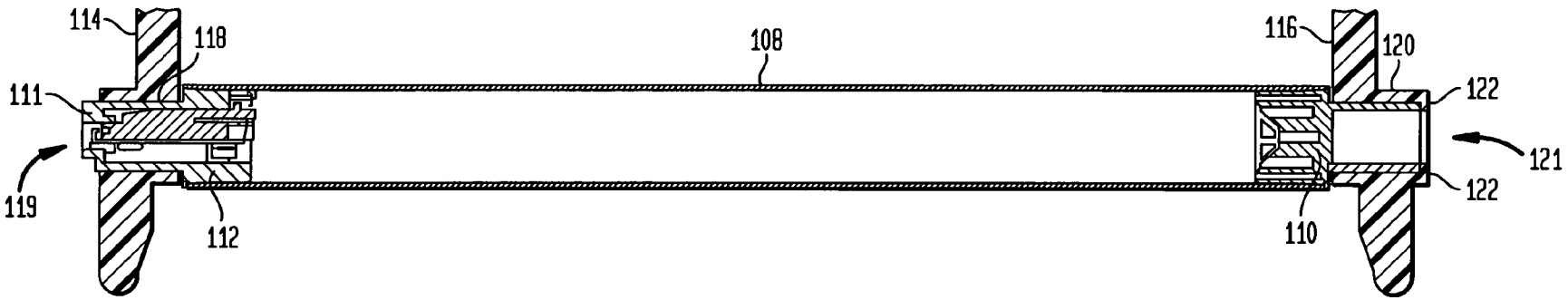
FIG. 3 (PRIOR ART)
FIG. 3 shows a cross-sectional view of the OPC drum and end caps of an HP 2600 toner cartridge.
Figure 3A:
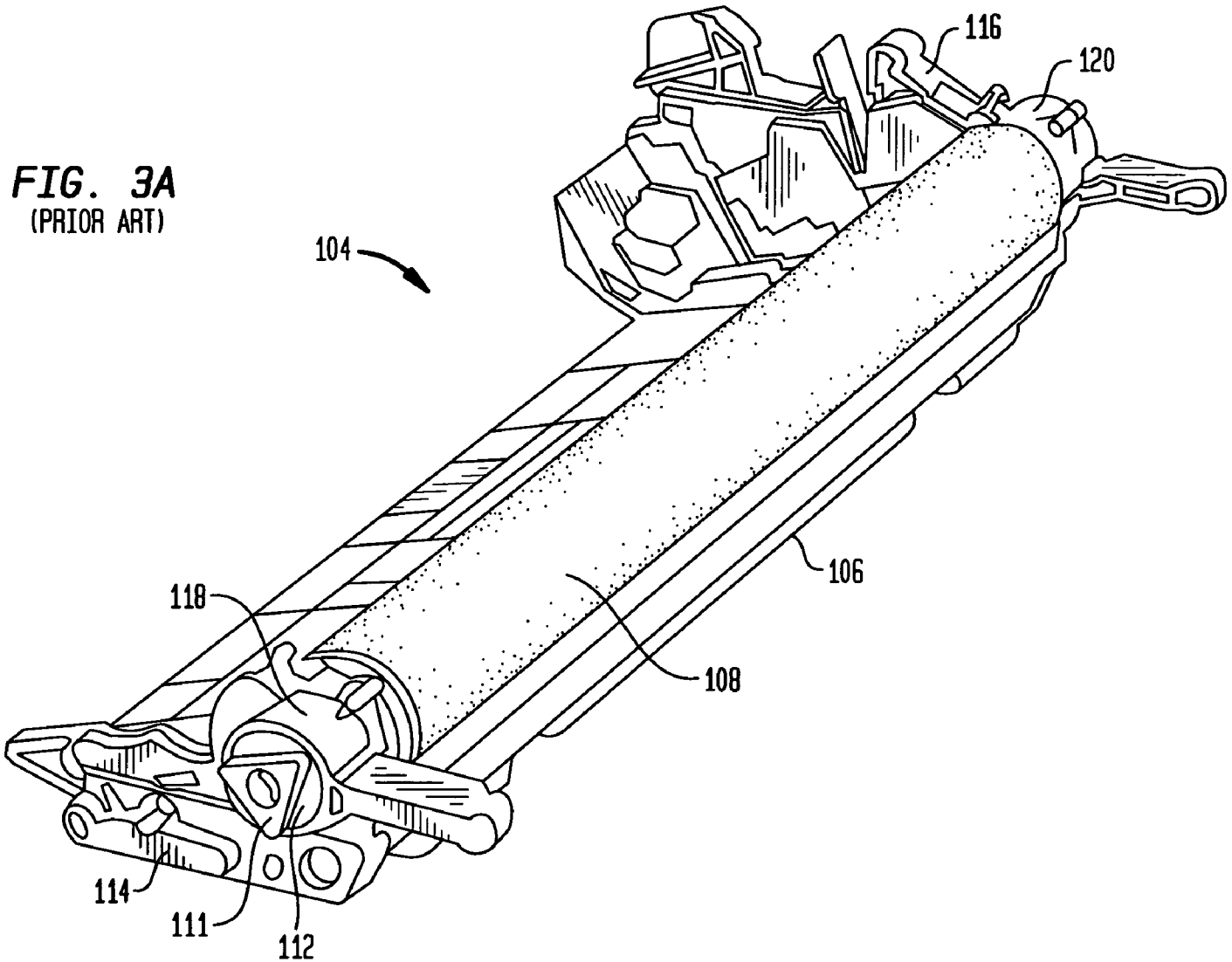
FIG. 3A (PRIOR ART)
FIGS. 3A and 3B show perspective views of a waste bin assembly.
Figure 3B:
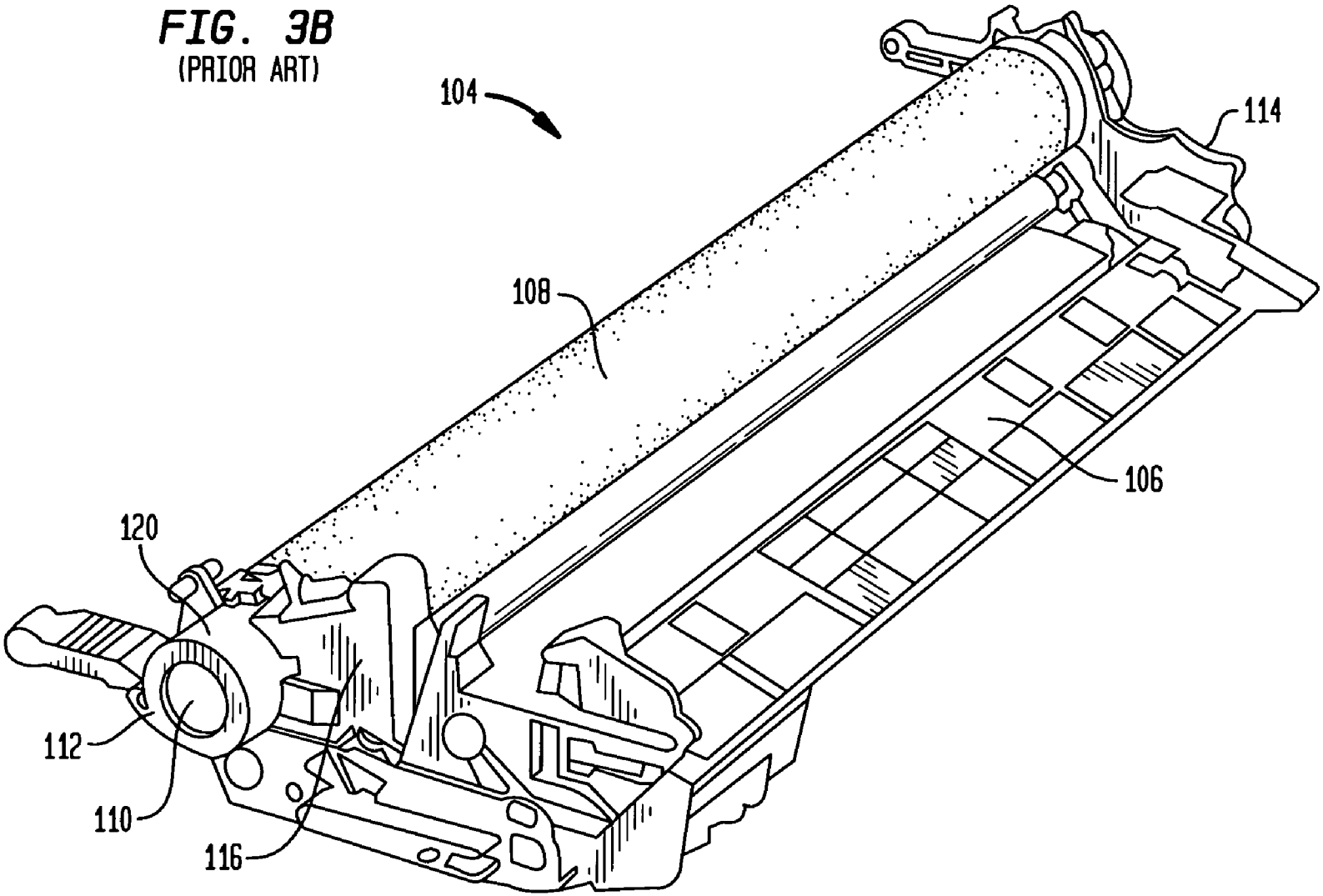
FIG. 3B (PRIOR ART)

FIGS. 1 and 2 show perspective views of a prior art toner cartridge 100. The toner cartridge 100 includes, among other components, a toner hopper assembly 102 and a waste bin assembly 104. The waste bin assembly 104 includes a waste bin 106 and an organic photo conductor (OPC) drum 108. The OPC drum 108 comprises a cylindrical aluminum tube having first and second hubs 110 and 112, with each hub 110 and 112 extending from an end of the OPC drum 108. The second hub 112 includes a trilobe 111 extension which is used by the printer to rotate the OPC drum 108 during the printing process. The OPC drum 108 is held in place by a drive side end cap 114 and a non-drive side end cap 116 which include OPC retaining members 118 and 120, respectively. The OPC retaining members 118 and 120 each include cylindrical openings 119 and 121 respectively which engage and hold the ends of the hubs 110 and 112 during the rotation of the OPC drum 108. The cylindrical opening 121 of the OPC retaining member 120 is narrowed at the end by a flange 122. A clearer view of the this relationship is provided in FIG. 3 which shows a cross-sectional view of a portion of the waste bin assembly 104 including the OPC drum 108, the drive side end cap 114 and the non-drive side end cap 116. See also FIGS. 3A and 3B, which show perspective views of the waste bin assembly 104 after removal from the toner cartridge 100. The end caps 114 and 116 are secured to the waste bin 106 using, among other techniques, an adhesive, which inhibits the removal of either of the end caps 114 and 116 without causing undesirable damage to the end caps 114 and 116 and the waste bin 104. As described above, such damage may result in print defects when the toner cartridge 100 is reassembled. Thus, it is desirable to remove a currently installed OPC drum and replace it with a new OPC drum without disturbing the end caps 114 and 116. After the old OPC drum is removed, a replacement OPC drum must be installed. As described in U.S. patent application Ser. No. 11/191,544, filed on the same date as the present application, titled "Systems and Methods for Remanufacturing Imaging Components" and incorporated by reference herein in its entirety, a variety of suitable techniques may be used to install a replacement OPC drum with causing undesirable damage to the end caps 114 and 116.

The present invention provides systems and methods removing an OPC drum in a toner cartridge having end caps that are fixedly secured to (and thus not readily removable from) the waste bin or other portion of the toner cartridge. Preferrably, prior to removing the existing OPC drum 108, the waste bin assembly 104 comprising the waste bin 106, end caps 114 and 116 and the OPC drum 108 is removed from the toner cartridge. The waste bin assembly 104 may be removed by extracting cartridge pins which hold the waste bin assembly 104 to the toner cartridge 100. To remove the OPC drum 108 without disturbing the end caps 114 and 116, one or more cuts should be made in the OPC drum 108 or hubs 110 and 112 to allow the OPC drum to be removed in pieces.

Figure 4:
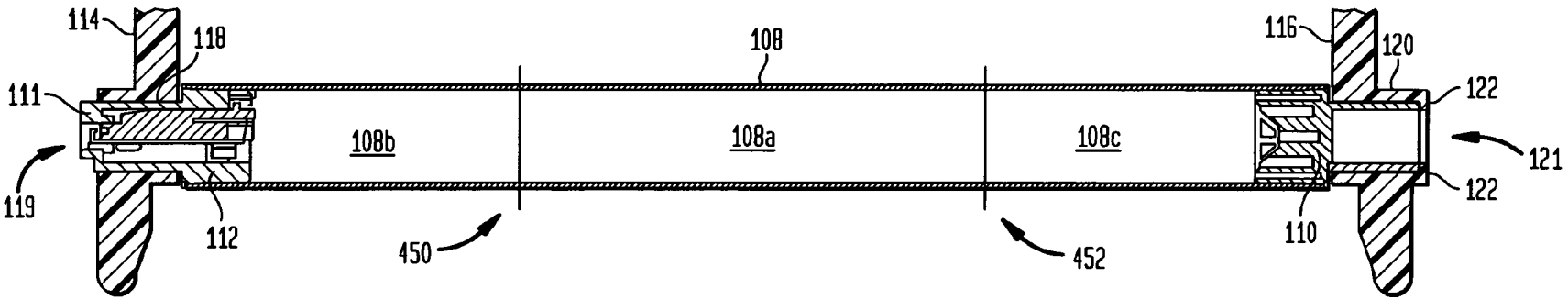
FIG. 4 shows a cross-sectional view of the OPC drum and end caps of an HP 2600 toner cartridge with exemplary cutting locations in accordance with the present invention.

In one aspect of the present invention, a cutter, such as a pipe cutter for example, may be used to make two cuts in the tube of the OPC drum 108. As seen in FIG. 4, the cuts may be made at locations 450 and 452, for example, to sever the drum into three portions. A center portion 108*a* of the OPC drum 108 may then be removed. Next, the two end portions 108*b* and 108*c* may be removed. In a preferred embodiment, the cuts should be performed without generating any debris which may impact printer performance. Other suitable cutting devices may be utilized also to perform the cutting operation. For example, a hacksaw may be used to make the cuts in the OPC drum 108.

Figure 5:
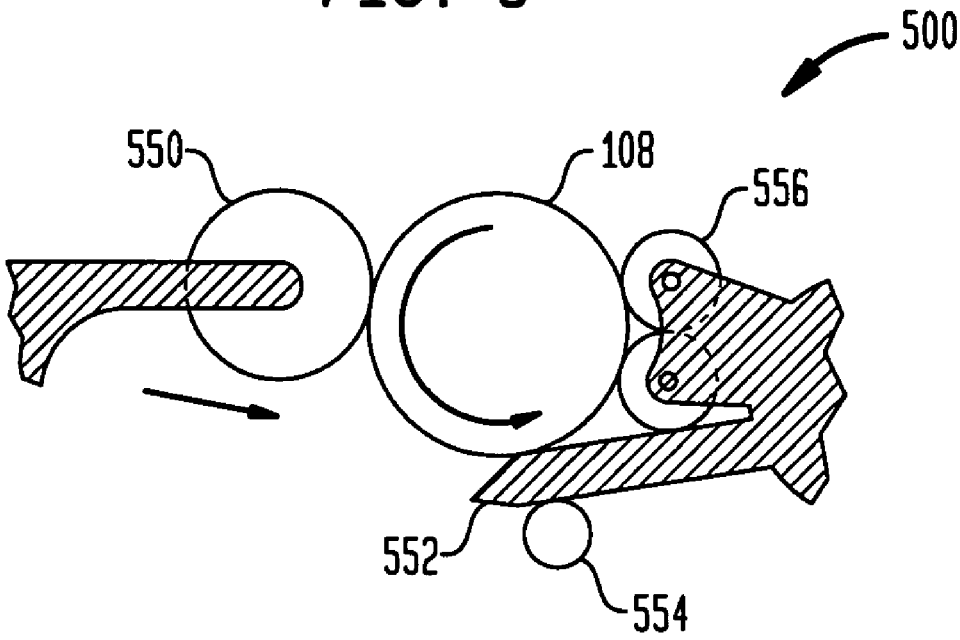
FIG. 5 shows a cross-sectional view of an OPC drum being cut in accordance with the present invention.

The process of cutting the OPC drum 108 may be automated to enhance efficiency. FIG. 5 shows a portion of an automated machine 500 which may be utilized to hold the waste bin assembly 104 in position while a drive motor rotates the OPC drum 108. One or more cutting blades 550 are then used to cut the OPC drum 108 as the rotation occurs. A spacer 552 may be inserted between the OPC drum 108 and a primary charge roller (PCR) 554 to prevent possible damage to the PCR 554 during the cutting process. The spacer 552 may suitably comprise a polymer resin or plastic resin. Guide support rollers 556 may be used to support the OPC drum 108 during the cutting process.

Figure 6:
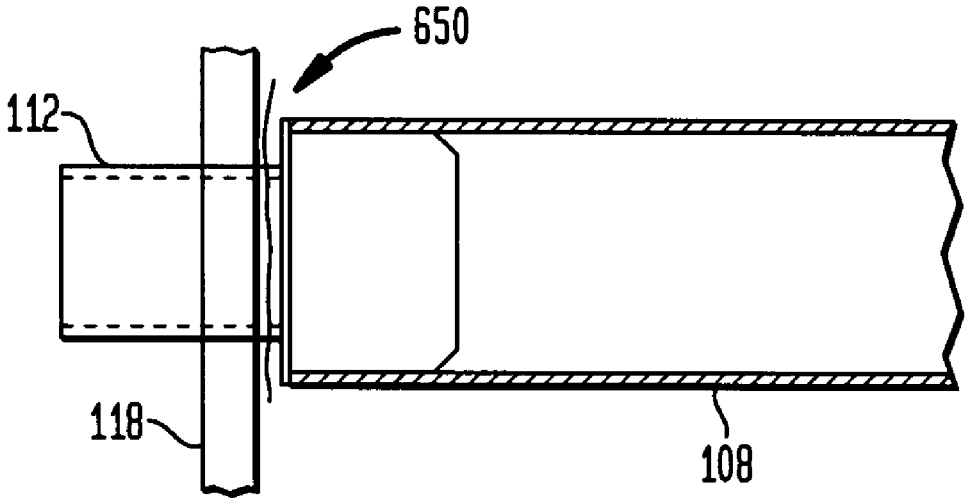
FIG. 6 shows a cross-sectional view of an OPC drum and end cap in accordance with the present invention.
Figure 7:
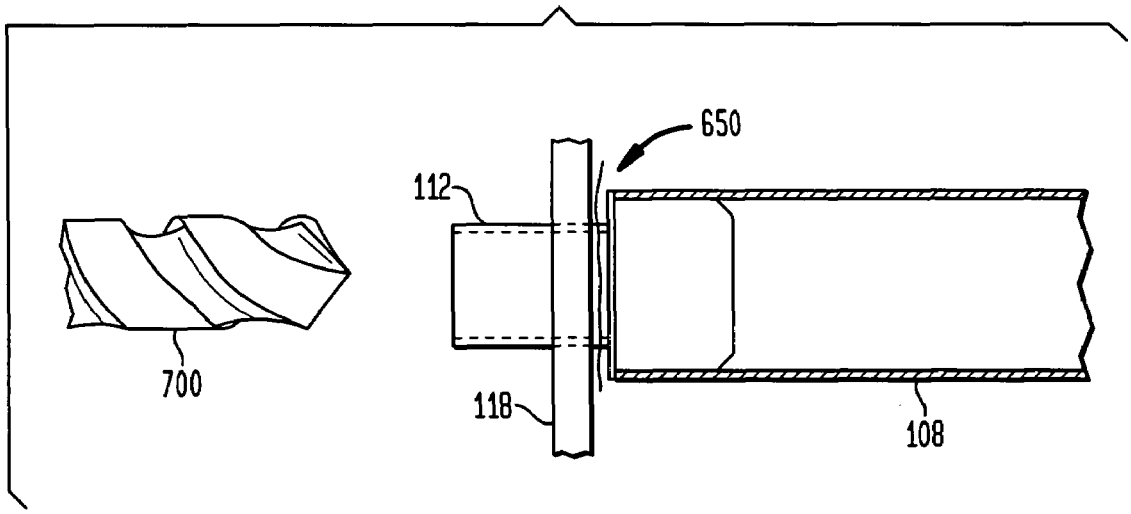
FIG. 7 shows a cross-sectional view of an OPC drum and end cap in accordance with another aspect of the present invention.

In another aspect of the present invention, the hubs 110 and 112 may be cut and separated from the center portion of the OPC drum 108. As seen in FIG. 6, a cut may be made through the hub 112 at location 650 between the OPC retaining member 118 and the end of the OPC drum 108. A corresponding cut may be made through the hub 110 to allow the OPC drum 108 to be removed from the waste bin assembly 104. The portions of the hubs 112 and 110 remaining in the OPC retaining members 118 and 120 may be removed also. In a preferred embodiment, the hubs 110 and 112 are cut off substantially flush with the end of the OPC drum 108. One or both of the hubs 110 and 112 may be cut by a variety of suitable techniques, such as a polyvinyl chloride (PVC) saw, a hot wire, a hot knife thermocutter, an ultrasonic knife or other appropriate cutting device, for example. Care should be taken not to damage the OPC retaining members 118 and 120 or other portions of the toner cartridge. This cutting technique may be automated to increase efficiency. To facilitate the cutting operation on the hubs 110 and 112, a portion of the interior of the hubs 110 and 112 may be removed to create a thinner hub wall. As shown in FIG. 7, a drill bit 700, for example, may be used to remove an inner portion of the hubs 110 and 112 by drilling through an end an into the interior of the hubs 110 and 112. The drill bit 700 is sized to be slightly smaller than the outer diameter of the hubs 110 and 112, yet large enough to leave only a thin wall of hub material remaining. In other words, the drill bit 700 increases the inner diameter of the hubs 110 and 112, and thus reduces the thickness of the hub walls. This thin wall may be easily cut at location 650 by utilizing a knife or other suitable cutting tool. In addition to the drill bit 700, other suitable tools such as a woodruff key cutter may be utilized to bore out a portion of the interior of the hubs 110 and 112.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. For example, two of the above techniques may be combined by performing one cut on a hub 110 or 112 and a second cut on the cylindrical body of the OPC drum 108. The following claims are in no way intended to limit the scope of the invention to the specific embodiments described herein.

What is claimed is:

1. A method of removing an organic photo conductor (OPC) drum from a toner cartridge comprising:

providing a waste bin assembly comprising an OPC drum held between first and second OPC retaining members secured to the waste bin assembly, said OPC drum including a cylindrical body and first and second hubs extending from ends of the OPC drum into said first and second OPC retaining members; and removing the OPC from the waste bin assembly without detaching the first and second OPC retaining members from the waste bin assembly, wherein the step of removing comprises cutting through the OPC drum at a first location, wherein the first location is through one of the hubs.

2. The method of claim 1 wherein the first location is between one of the OPC retaining members and an end of the cylindrical body of the OPC drum.

3. A method of removing an organic photo conductor (OPC) drum from a toner cartridge comprising:

providing a waste bin assembly comprising an OPC drum held between first and second OPC retaining members secured to the waste bin assembly, said OPC drum including a cylindrical body and first and second hubs extending from ends of the OPC drum into said first and second OPC retaining members; and removing the OPC from the waste bin assembly without detaching the first and second OPC retaining members from the waste bin assembly, wherein the step of removing comprises cutting through the OPC drum at a first location, wherein further comprising, before cutting through the OPC drum at a first location, the step of:

inserting a spacer element between the OPC drum and a primary charge roller (PCR) of the waste bin assembly.

4. A method of removing an organic photo conductor (OPC) drum from a toner cartridge comprising:

providing a waste bin assembly comprising an OPC drum held between first and second OPC retaining members secured to the waste bin assembly, said OPC drum including a cylindrical body and first and second hubs extending from ends of the OPC drum into said first and second OPC retaining members; and removing the OPC from the waste bin assembly without detaching the first and second OPC retaining members from the waste bin assembly, wherein end caps comprising the OPC retaining members are not readily removable from the waste bin assembly, wherein the step of removing comprises cuffing through the OPC drum at a first location, wherein the first location is through one of the hubs.

5. The method of claim 4 wherein the first location is between one of the OPC retaining members and an end of the cylindrical body of the OPC drum.

6. A method of removing an organic photo conductor (OPC) drum from a toner cartridge comprising:

providing a waste bin assembly comprising an OPC drum held between first and second OPC retaining members secured to the waste bin assembly, said OPC drum including a cylindrical body and first and second hubs extending from ends of the OPC drum into said first and second OPC retaining members; and removing the OPC from the waste bin assembly without detaching the first and second OPC retaining members from the waste bin assembly, wherein end caps comprising the OPC retaining members are not readily removable from the waste bin assembly, wherein the step of removing comprises cutting through the OPC drum at a first location, wherein further comprising, before cutting through the OPC drum at a first location, the step of:

inserting a spacer element between the OPC drum and a primary charge roller (PCR) of the waste bin assembly.

* * * * *